US008141647B2

(12) United States Patent
Kriesels et al.

(10) Patent No.: US 8,141,647 B2
(45) Date of Patent: Mar. 27, 2012

(54) METHOD OF RADIALLY EXPANDING A TUBULAR ELEMENT

(75) Inventors: Petrus Cornelis Kriesels, Rijswijk (NL); Pieter Van Nieuwkoop, Rijswijk (NL); Antonius Leonardus Maria Wubben, Rijswijk (NL)

(73) Assignee: Shell Oil Company, Houston, TX (US)

( * ) Notice: Subject to any disclaimer, the term of this patent is extended or adjusted under 35 U.S.C. 154(b) by 266 days.

(21) Appl. No.: 12/515,456

(22) PCT Filed: Nov. 20, 2007

(86) PCT No.: PCT/EP2007/062538

§ 371 (c)(1),
(2), (4) Date: May 19, 2009

(87) PCT Pub. No.: WO2008/061969

PCT Pub. Date: May 29, 2008

(65) Prior Publication Data

US 2009/0255689 A1 Oct. 15, 2009

(30) Foreign Application Priority Data

Nov. 21, 2006 (EP) ..... 06124439

(51) Int. Cl.
*E21B 43/10* (2006.01)

(52) U.S. Cl. ..... 166/380; 166/242.1; 166/207

(58) Field of Classification Search ..... 166/206, 166/207; 405/150.1, 184.2
See application file for complete search history.

(56) References Cited

U.S. PATENT DOCUMENTS

| | | | | |
|---|---|---|---|---|
| 4,427,480 | A * | 1/1984 | Kamuro et al. | 156/287 |
| 5,634,743 | A * | 6/1997 | Chandler | 405/150.1 |
| 5,803,666 | A * | 9/1998 | Keller | 405/146 |
| 5,816,345 | A * | 10/1998 | Keller | 175/53 |
| 7,387,174 | B2 * | 6/2008 | Lurie | 175/57 |
| 2009/0211765 | A1 * | 8/2009 | Keller | 166/377 |

FOREIGN PATENT DOCUMENTS

| | | | |
|---|---|---|---|
| EP | 44706 | | 1/1982 |
| WO | WO9947340 | | 9/1999 |
| WO | WO 9947340 | A1 * | 9/1999 |
| WO | WO0188338 | | 11/2001 |
| WO | WO2004020893 | | 3/2004 |
| WO | WO2005024178 | | 3/2005 |
| WO | WO 2005024178 | A1 * | 3/2005 |

* cited by examiner

*Primary Examiner* — David Bagnell
*Assistant Examiner* — Jacob Hall

(57) ABSTRACT

A method is provided of radially expanding a tubular element. The method comprises inducing the wall of the tubular element to bend radially outward and in axially reverse direction so as to form an expanded section of the tubular element extending around an unexpanded section of the tubular element, wherein said bending occurs in a bending zone of the wall, and wherein an annular space is defined between the unexpanded and expanded sections. At least one guide member is located in the annular space, each guide member being arranged to guide the wall during said bending so that the wall bends at an increased bending radius relative to bending of the wall in case the guide member is absent from the annular space.

14 Claims, 9 Drawing Sheets

METHOD OF RADIALLY EXPANDING A TUBULAR ELEMENT

PRIORITY CLAIM

The present application claims priority from PCT/EP2007/062538, filed 20 Nov. 2007, which claims priority from European Patent Application 06124439.8 filed 21 Nov. 2006.

FIELD OF THE INVENTION

The present invention relates to a method of radially expanding a tubular element.

BACKGROUND OF THE INVENTION

Expansion of tubular elements finds application in various fields of technology including, for example, the production of hydrocarbon fluid from a wellbore formed in an earth formation. Wellbores are generally provided with one or more casings or liners to provide stability to the wellbore wall, and/or to provide zonal isolation between different earth formation layers. The terms "casing" and "liner" normally refer to wellbore tubulars for supporting and stabilising the wellbore wall, whereby it is generally understood that a casing extends from a downhole location to surface, whereas a liner does not fully extend to surface. However, in this specification the terms "casing" and "liner" are used interchangeably and without intended distinction.

In conventional wellbore construction, several casings are set at different depth intervals, and in a nested arrangement. Each subsequent casing has to be lowered through the previous casing and therefore must have a smaller diameter than the previous casing. As a result, the available wellbore diameter for oil and gas production decreases with depth. To alleviate this drawback, it has been practiced to radially expand wellbore tubulars after lowering into the wellbore. Such expanded tubular element is, for example, an expanded casing section or an expanded clad against a previously installed existing casing. If each casing section is expanded to about the same diameter, the available wellbore diameter remains substantially constant along (a portion of) its depth, as opposed to the conventional, nested, arrangement whereby the available wellbore diameter decreases with depth.

EP-044706-A2 discloses a method of radially expanding a tubular element by eversion of an inner tube to form an outer tube around a portion of the inner tube, the tubes being interconnected at their respective forward ends to present a rollover area capable of being moved forwardly. The rollover area is induced to move forward by pumping driving fluid into the annular space between the inner and outer tubes. As the tubular element expands to a larger diameter, the wall stretches in circumferential direction during the eversion process. Therefore the bending radius of the wall in the rollover area does not only depend on the resistance to bending of the wall, but also on the resistance to stretching of the wall in circumferential direction. Such resistance to stretching tends to reduce the diameter of the expanded section, and thereby tends to reduce the bending radius of the wall in the rollover area.

Due to such relatively small bending radius, the wall is subjected to relatively high strains, thereby leading to an increased risk of damage to the wall during the eversion process.

It is therefore an object of the invention to provide an improved method of radially expanding a tubular element, which overcomes the drawbacks of the prior art.

SUMMARY OF THE INVENTION

In accordance with the invention there is provided a method of radially expanding a tubular element, the method comprising inducing the wall of the tubular element to bend radially outward and in axially reverse direction so as to form an expanded section of the tubular element extending around an unexpanded section of the tubular element, wherein said bending occurs in a bending zone of the wall, wherein an annular space is defined between the unexpanded and expanded sections, and wherein at least one guide member is located in the annular space, each guide member being arranged to guide the wall during said bending so that the wall bends at an increased bending radius relative to bending of the wall in case the guide member is absent from the annular space.

It is to be understood that the expression "bending the wall radially outward and in axially reverse direction" refers to eversion of the tubular element whereby a U-shaped portion of the wall is formed of which one leg is the unexpanded section and the other leg is the expanded section. With the method of the invention it is achieved that the wall bends to a relatively large bending radius during the eversion process. That is, the bending radius is larger than a bending radius achieved if the wall of the tubular element would be induced to bend radially outward and in axially reverse direction in the absence of the guide member. The risk of damage to the wall due to overstressing is thereby reduced or eliminated.

Further, the expression "unexpanded section of the tubular element" refers to a section of the tubular element that has not (yet) been expanded by eversion with the method of the invention. Thus, the expression does not exclude sections of the tubular element that were subjected to expansion before eversion with the method of the invention.

Suitably the guide member moves the expanded section radially outward relative to the unexpanded section during said bending by virtue of the guide member becoming compressed between the unexpanded and expanded sections.

The guide member should be sufficiently large to become compressed between the unexpanded and expanded sections. Thus, the guide member should be larger in size than the width of a hypothetical annular space that would result from eversion of the tubular element whereby no guide member is present in the annular space.

To progressively form the expanded tubular section it is preferred that the length of said expanded section is increased by axially moving the unexpanded section relative to the expanded section in the direction of the bending zone. The bending zone defines the location where the instantaneous bending process takes place. Therefore, by axially moving the unexpanded section towards the bending zone, relative to the expanded section, it is achieved that the wall of the tubular element is progressively expanded in a rolling motion.

If the tubular element extends in vertical direction, for example into a wellbore, the weight of the unexpanded tubular section can be utilised to contribute to the force needed to induce downward movement of the unexpanded section.

Suitably the guide member includes a body having a substantially circular cross-section so as to allow the guide member to roll along said wall during axially moving the unexpanded section relative to the expanded section in the direction of the bending zone.

In order to allow the guide member to be adequately guided along the wall, suitably, for each guide member, the unexpanded section is at the outer surface thereof provided with a respective guide profile extending substantially parallel to a central longitudinal axis of the tubular element, the guide profile being adapted to allow the guide member to roll along the guide profile during axial movement of the unexpanded section relative to the expanded section.

Suitably each guide profile comprises, for example, a groove formed in the wall of the unexpanded section.

To achieve substantially uniform bending of the wall along its circumference, preferably a plurality of said guide members is located in the annular space and near the bending zone, the guide members being regularly spaced in circumferential direction of the annular space.

In a preferred embodiment the tubular element extends into a wellbore formed in an earth formation whereby, for example, the expanded tubular section extends adjacent the wall of the wellbore, or adjacent the wall of another tubular element arranged in the wellbore. In such application, the bending zone of the wall is suitably located at a lower end of the tubular element.

Effectively, the expanded section is kept stationary in the wellbore and the unexpanded section is moved in downward direction of the wellbore so as to progressively increase the length of the expanded section.

The bending process is suitably initiated at a lower end of the (yet) unexpanded wall. If the weight of the unexpanded section is insufficient to induce movement of the bending zone, suitably a downward force is exerted to the unexpanded tubular section to move the unexpanded tubular section in downward direction of the wellbore.

Advantageously the wellbore is being drilled with a drill string extending through the unexpanded tubular section. In such application the unexpanded tubular section and the drill string preferably are lowered simultaneously through the wellbore during drilling with the drill string.

To reduce any buckling tendency of the unexpanded section during the expansion process, the unexpanded section advantageously is centralised in the expanded section using any suitable centralising means.

BRIEF DESCRIPTION OF THE DRAWINGS

The invention will be described hereinafter in more detail and by way of example, with reference to the accompanying drawings in which.

DETAILED DESCRIPTION OF PREFERRED EMBODIMENTS

In the Figures and the description like reference element numerals relate to like components.

Figure 1:
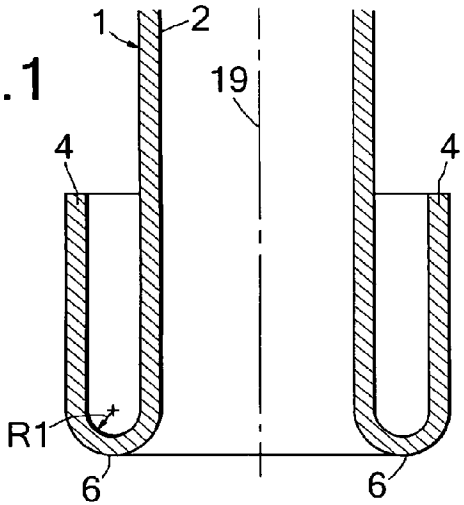
FIG. 1 schematically shows a method of eversion of a tubular element not in accordance with the invention.

It should be noted that FIG. 1 and the corresponding portion of the description relate to eversion of a tubular element not in accordance with the method of the invention. In FIG. 1 is shown a radially expandable tubular element 1 comprising an unexpanded section 2 and a radially expanded section 4 extending around a portion of the unexpanded section 2. The unexpanded and expanded sections 2, 4 are interconnected at their respective lower ends by a U-shaped wall portion 6 having an inner surface of bending radius $R_1$. The U-shaped wall portion 6 defines a bending zone of the tubular element 1.

The expanded section 4 is formed by bending the lower end of the wall of the tubular element 1 radially outward and in axially reverse direction. Subsequently the unexpanded section 2 is moved downward relative to the expanded section 4 so that, as a result, the unexpanded section 2 gradually becomes everted to form the expanded section 4. The bending radius $R_1$ at the U-shaped wall portion 6 results from an equilibrium between the tendency of the wall to assume a relatively large bending radius due to the inherent bending stiffness of the wall, and the tendency of the wall to assume a relatively small bending radius due to the inherent resistance of the wall to stretching in circumferential direction. The bending radius $R_1$ is hereinafter referred to as the natural bending radius.

Figure 2:
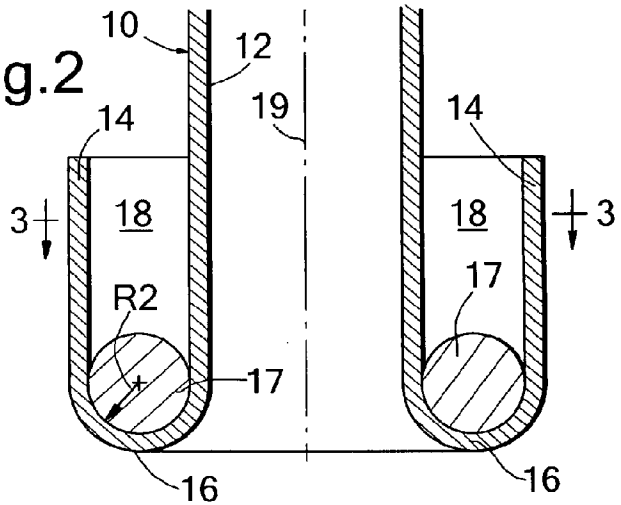
FIG. 2 schematically shows a first embodiment of a tubular element expanded with the method of the invention.
Figure 3:
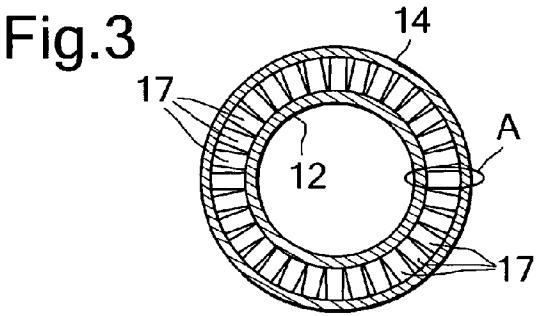
FIG. 3 schematically shows cross-section 3-3 of FIG. 2.
Figure 4:
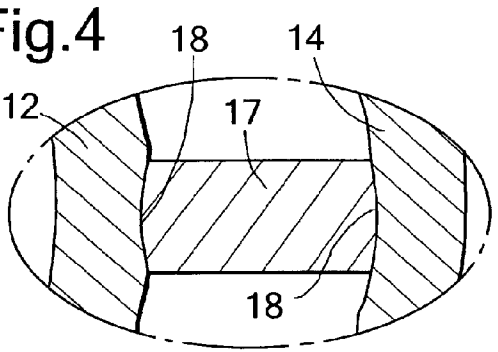
FIG. 4 schematically shows detail A of FIG. 3.

FIGS. 2-4 show a first embodiment of a tubular element 10 expanded with the method of the invention, the tubular element 10 having mechanical properties similar to those of the tubular element 1 of FIG. 1. Furthermore, the geometrical properties of tubular element 10 before expansion thereof, are similar to geometrical properties of the tubular element 1 before expansion thereof. The tubular element 10 comprises an unexpanded section 12 and a radially expanded section 14 extending around a portion of the unexpanded section 12. The unexpanded and expanded sections 12, 14 are interconnected at their respective lower ends by a U-shaped wall portion 16 having an inner surface of bending radius $R_2$ larger than $R_1$ mentioned above with reference to FIG. 1. The U-shaped wall portion 16 defines a bending zone of the tubular element 10.

A plurality of guide members in the form of rollers 17 are positioned in the annular space 18 defined between the unexpanded section 12 and the expanded section 14. The rollers 17 are located at the curved inner surface of the U-shaped wall portion 16, and are regularly spaced along the circumference of the U-shaped wall portion 16. Each roller 17 is formed as a cylindrical body, and is oriented so that its central longitudinal axis extends substantially perpendicular to the radial direction of the tubular element 10. Furthermore, each roller 17 has a diameter larger than twice the bending radius $R_1$ of the U-shaped wall portion 6 of the tubular element 1 referred to in FIG. 1. The unexpanded section 12 is at the outer surface thereof provided, for each roller 17, with a respective guide profile in the form of a groove 18 formed in the wall of the unexpanded section 12. Each groove 18 extends substantially parallel to a central longitudinal axis 19 of the tubular element 10, and is adapted to allow the corresponding roller 17 to roll along the groove 18 during axial movement of the unexpanded section 12 relative to the expanded section 14.

During normal operation of the first embodiment (FIGS. 2-4) the expanded section 14 is initially formed by bending the wall of the tubular element 10 at the lower end thereof radially outward and in axially reverse direction, or in any other suitable manner. Subsequently the unexpanded section 12 is moved downward relative to the expanded section 14 so that, as a result, the unexpanded section 12 is gradually everted to form the expanded section 14. Since the rollers 17 have a diameter larger than twice the natural bending radius $R_1$, the rollers 17 become compressed between the unexpanded and expanded sections 12, 14 and thereby induce the wall of the tubular element 10 to bend at the increased bending radius $R_2$. As a result the tubular element 10 is expanded to a larger diameter than the tubular element 1 where the rollers are absent.

Figure 5:
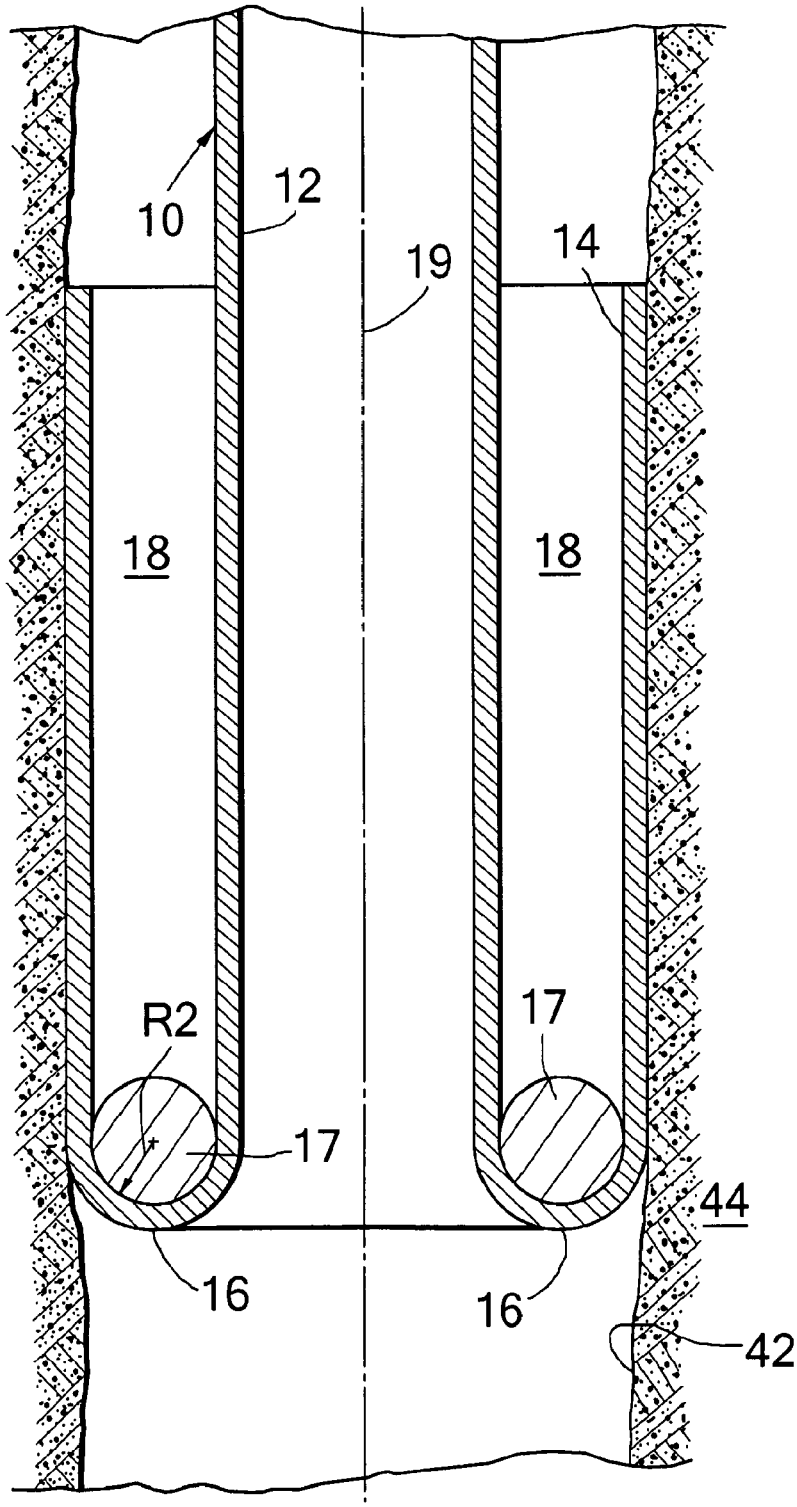
FIG. 5 schematically shows the tubular element of the first embodiment during expansion in a wellbore.

In FIG. 5 is shown the tubular element 10 of FIGS. 2-4 when positioned in a wellbore 42 formed in an earth formation 44. During normal operation the lower end portion of the wall of the (yet unexpanded) tubular element 10 is bent radially outward and in axially reverse direction by any suitable means so as to initially form the U-shaped lower section 16. Subsequently, a downward force is applied to the unexpanded section 12 to move the unexpanded section 12 gradually downward. The unexpanded section 12 thereby becomes progressively everted to form into the expanded section 14. During the eversion process, the U-shaped lower section 16 moves downward at approximately half the speed of the unexpanded section 12. By virtue of the presence of the rollers 17 in the U-shaped wall portion 16, the bending radius $R_2$ of the U-shaped wall portion 16 is relatively large (compared to $R_1$ referred to above) so that the tubular element 10 is expanded to a relatively large diameter. If desired, the tubular element 10 and/or the rollers 17 can be selected such that the expanded tubular section 14 becomes firmly expanded against the wellbore wall so that a seal is formed between the expanded tubular section 14 and the wellbore wall.

Figure 6:
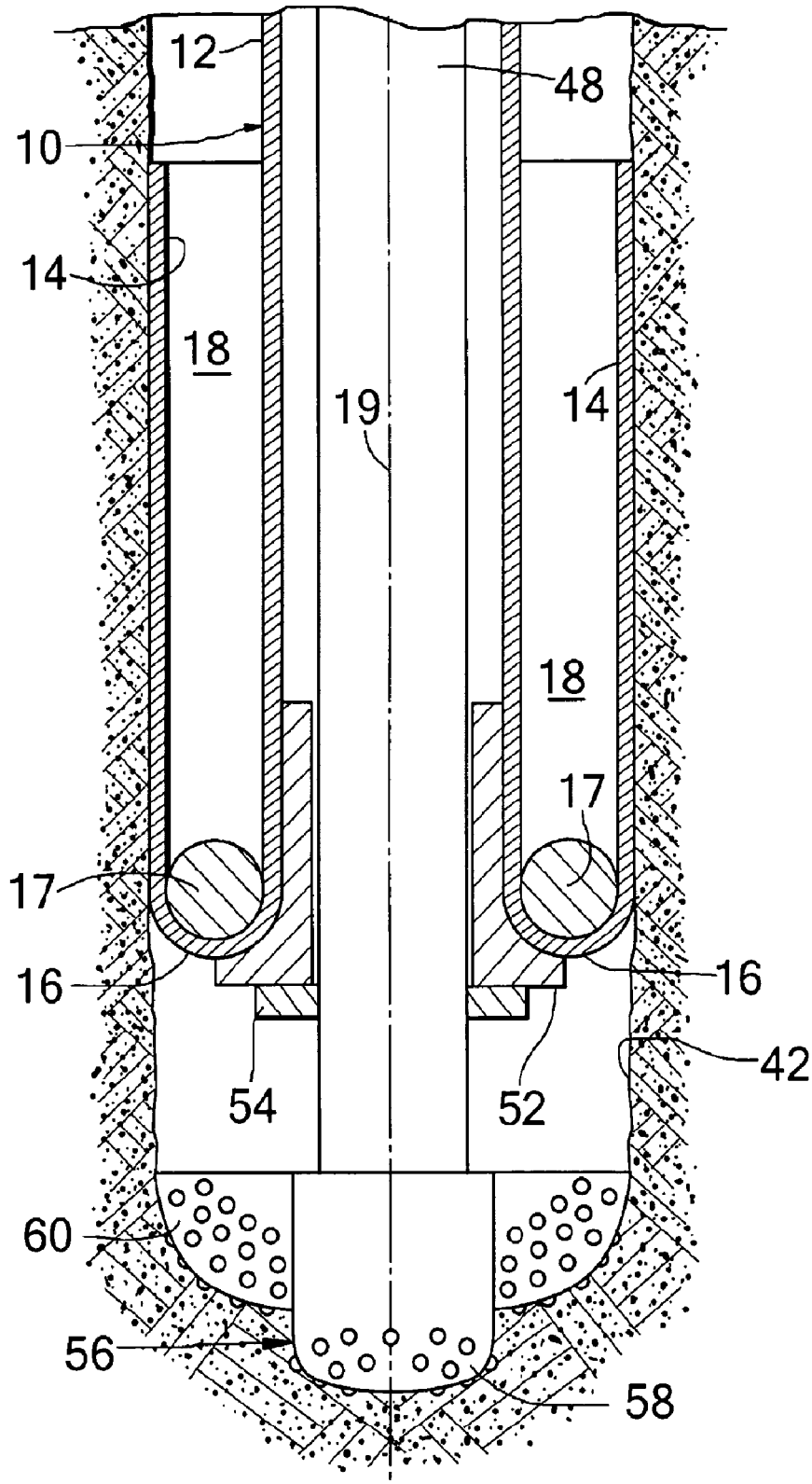
FIG. 6 schematically shows a second embodiment of a tubular element expanded with the method of the invention.

In FIG. 6 is shown the second embodiment that includes tubular element 10 of FIG. 2 in combination with a drill string 48 extending from surface through the unexpanded section 12 to the bottom of the wellbore 42. The drill string 48 is provided with a tubular guide device 52 for guiding and supporting the U-shaped lower section 16 of the tubular element 10, the guide device 52 being supported by a support ring 54 connected to the drill string 48. The support ring 54 is made radially retractable so as to allow it to pass in retracted mode through the guide device 52 and through the unexpanded section 12. Furthermore, the drill string 48 is provided with a drill bit 56 that is driven in rotation either by a downhole motor (not shown) or by rotation of the drill string 48 itself. The drill bit 56 comprises a pilot bit 58 and a collapsible reamer 60 for drilling the wellbore 42 to its nominal diameter. The pilot bit 58 and the reamer 60, when in collapsed mode, have a maximum diameter slightly smaller than the internal diameter of the guide device 52 so as to allow the pilot bit 58 and the reamer 60 to be retrieved to surface through the guide device 52 and through the unexpanded tubular section 12.

During normal operation of the second embodiment (FIG. 6), the drill bit 56 is driven in rotation to deepen the wellbore 42 whereby the drill string 48 and the unexpanded tubular section 12 move simultaneously downward into the wellbore 42. The unexpanded tubular section 12 can be assembled from individual pipe sections at surface, as is normal practice for tubular strings such as drill strings, casings or liners. Alternatively the unexpanded tubular section can be supplied as a continuous tubular element, such as a coiled tubing.

The guide device 52 supports the U-shaped lower portion 16 of the tubular wall, and guides the wall during radially outward bending thereof. Furthermore, the guide device 52 prevents radially inward bending of the wall, as such radially inward bending could otherwise occur due to compression of the rollers 17 between the unexpanded and expanded tubular sections 12, 14.

Initially a downward force needs to be applied to the unexpanded section 12 to induce lowering thereof simultaneously with the drill string 48. As the length of the unexpanded section 12 in the wellbore 42 increases, the weight of the unexpanded section 12 gradually replaces the applied downward force. Eventually, after the weight of the unexpanded section has fully replaced the applied downward force, an upward force may need to be applied to the unexpanded section 12 to prevent overloading of the U-shaped lower portion 16.

The weight of the unexpanded tubular section 12 also can be used to thrust the drill bit 56 forward during drilling of the wellbore 42. Such thrust force is transmitted to the drill bit 56 via the guide device 52 and the support ring 54. In an alternative embodiment, the guide device 52 is dispensed with and the thrust force is directly transmitted from the unexpanded tubular section to the drill string, for example via a suitable thrust bearing (not shown) between the unexpanded section and the drill string.

Thus, by gradually lowering the unexpanded tubular section 12 into the wellbore 42, the U-shaped lower wall portion 16 progressively bends in radially outward and axially reverse direction, thereby progressively forming the expanded tubular section 14. During the expansion process, the U-shaped lower portion 16 is supported and guided by the guide device 52 so as to promote bending of the wall of the unexpanded section 12.

By virtue of the presence of the rollers 17 in the U-shaped wall portion 16, the bending radius $R_2$ of the U-shaped wall portion 16 is larger than the natural bending radius $R_1$ so that the tubular element 10 is expanded to a relatively large diameter. If desired, the mechanical properties and the dimensions of the tubular element 10 and/or the rollers 17 can be selected such that the expanded tubular section 14 becomes firmly expanded against the wellbore wall so that a seal is formed between the expanded tubular section 14 and the wellbore wall.

When it is required to retrieve the drill string 48 to surface, for example when the drill bit is to be replaced or after drilling has completed, the support ring 54 is radially retracted and the reamer bit 60 collapsed. Thereafter the drill string 48 is retrieved through the unexpanded tubular section 12 to surface. The guide device 52 can remain downhole. Alternatively the guide member can be made collapsible so as to allow it to be retrieved to surface in collapsed mode through the unexpanded tubular section 12.

Figure 7:
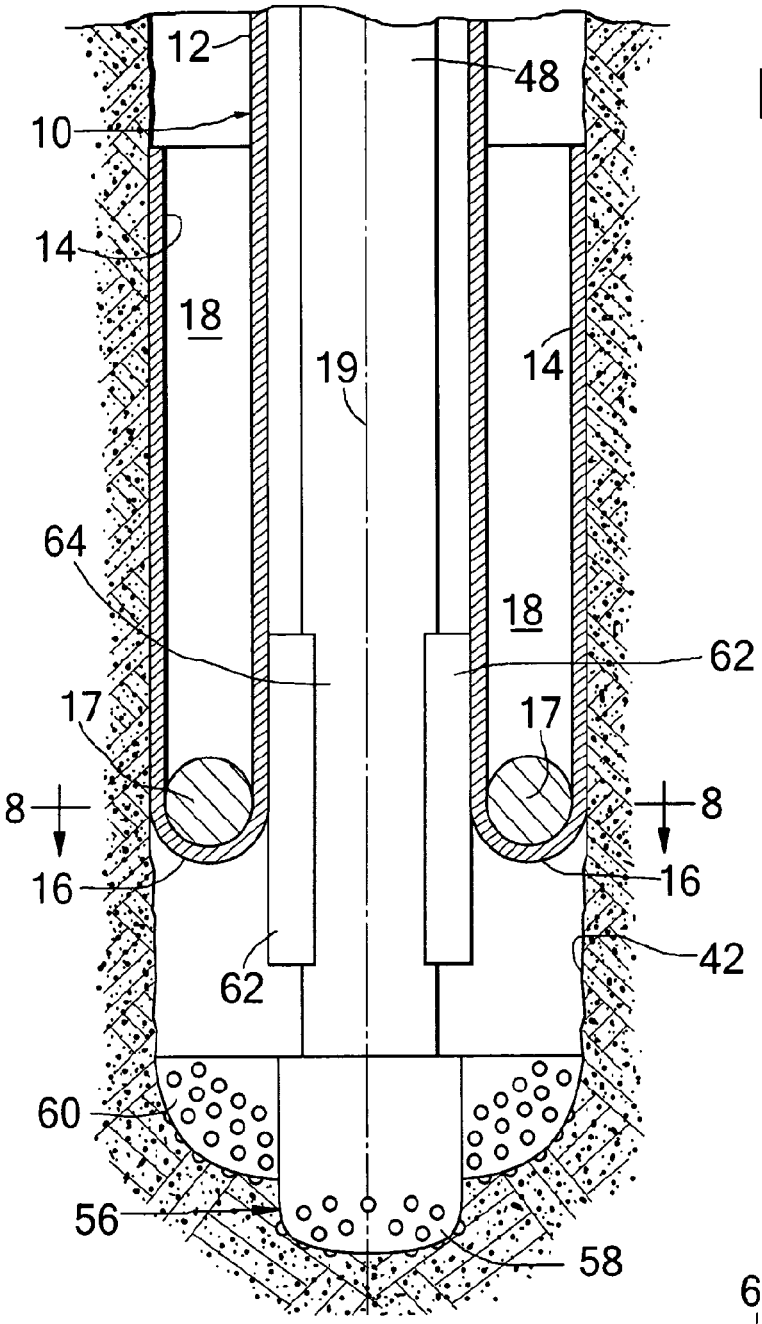
FIG. 7 schematically shows a third embodiment of a tubular element expanded with the method of the invention.
Figure 8:
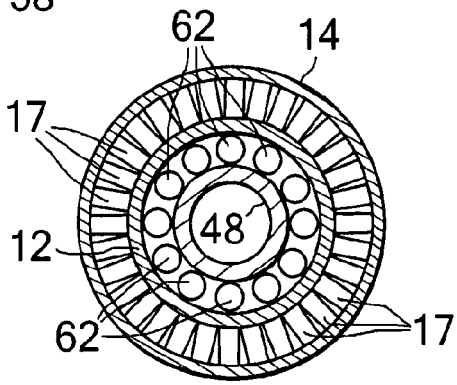
FIG. 8 shows cross-section 8-8 of FIG. 7.

In FIGS. 7 and 8 is shown the third embodiment, which is substantially similar to the second embodiment except that the third embodiment includes a different guide device. The guide device of the third embodiment comprises a plurality of cylindrical rollers 62 arranged in a corresponding groove 64 of the drill string 48 at the level of the rollers 17. The cylindrical rollers 62 roll along the groove 64 and along the inner surface of the unexpanded section 12 during rotation of the drill string 48.

Normal operation of the third embodiment (FIGS. 7 and 8) is substantially similar to normal operation of the second embodiment, except that the cylindrical rollers 62 radially support the unexpanded section 12 and thereby prevent radially inward bending of the U-shaped wall portion 16, which would otherwise occur due to the effect of the rollers 17 in the annular space 18. Axial friction between the unexpanded section 12 and the rollers 62 is reduced as a result of the rolling motion of the rollers 62 along the inner surface of the unexpanded section 12. The frictional resistance to downward movement of the unexpanded section 12 is thereby reduced.

Figure 9:
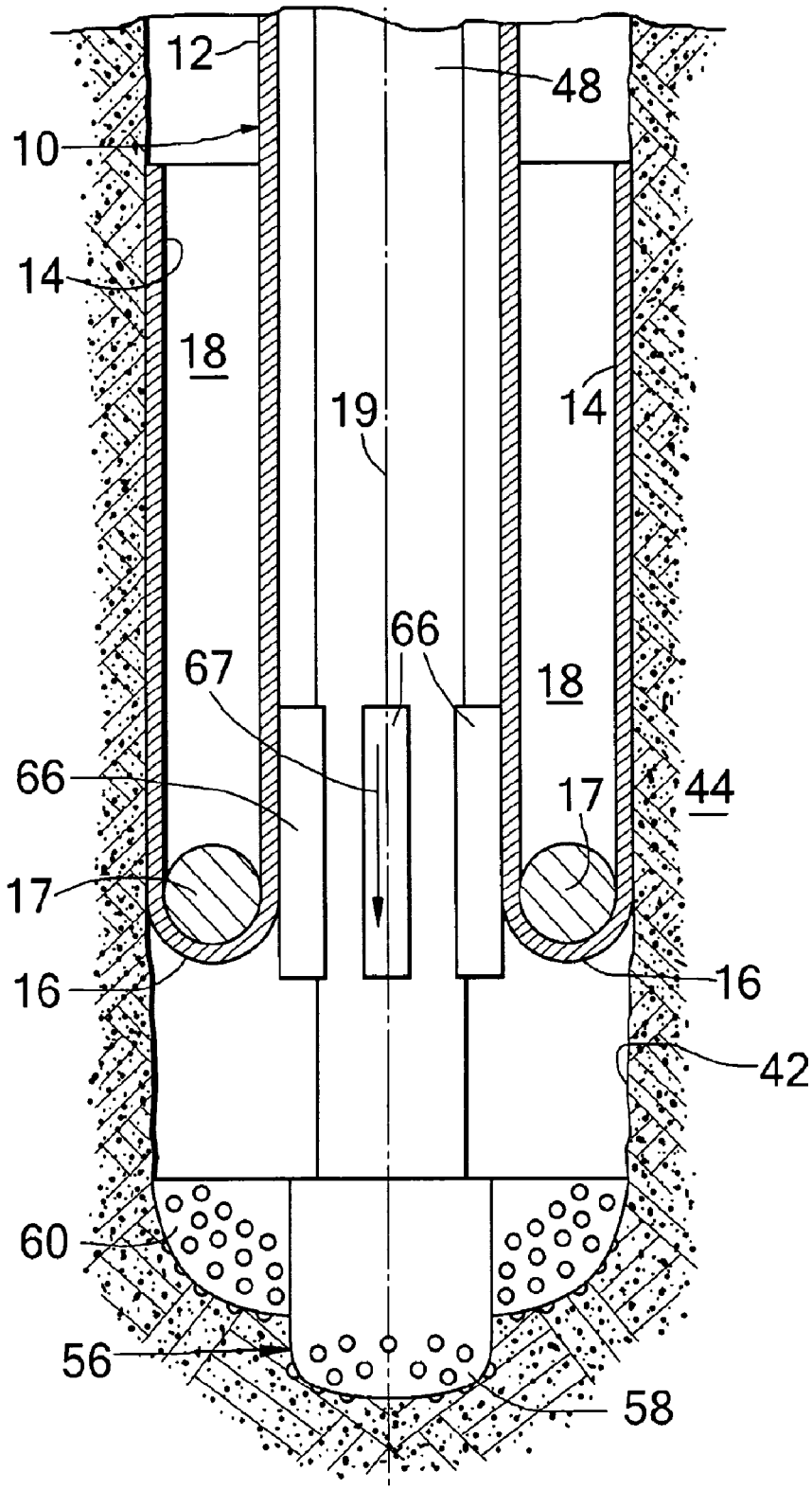
FIG. 9 schematically shows a fourth embodiment of a tubular element expanded with the method of the invention, during a primary stage of the expansion process.
Figure 10:
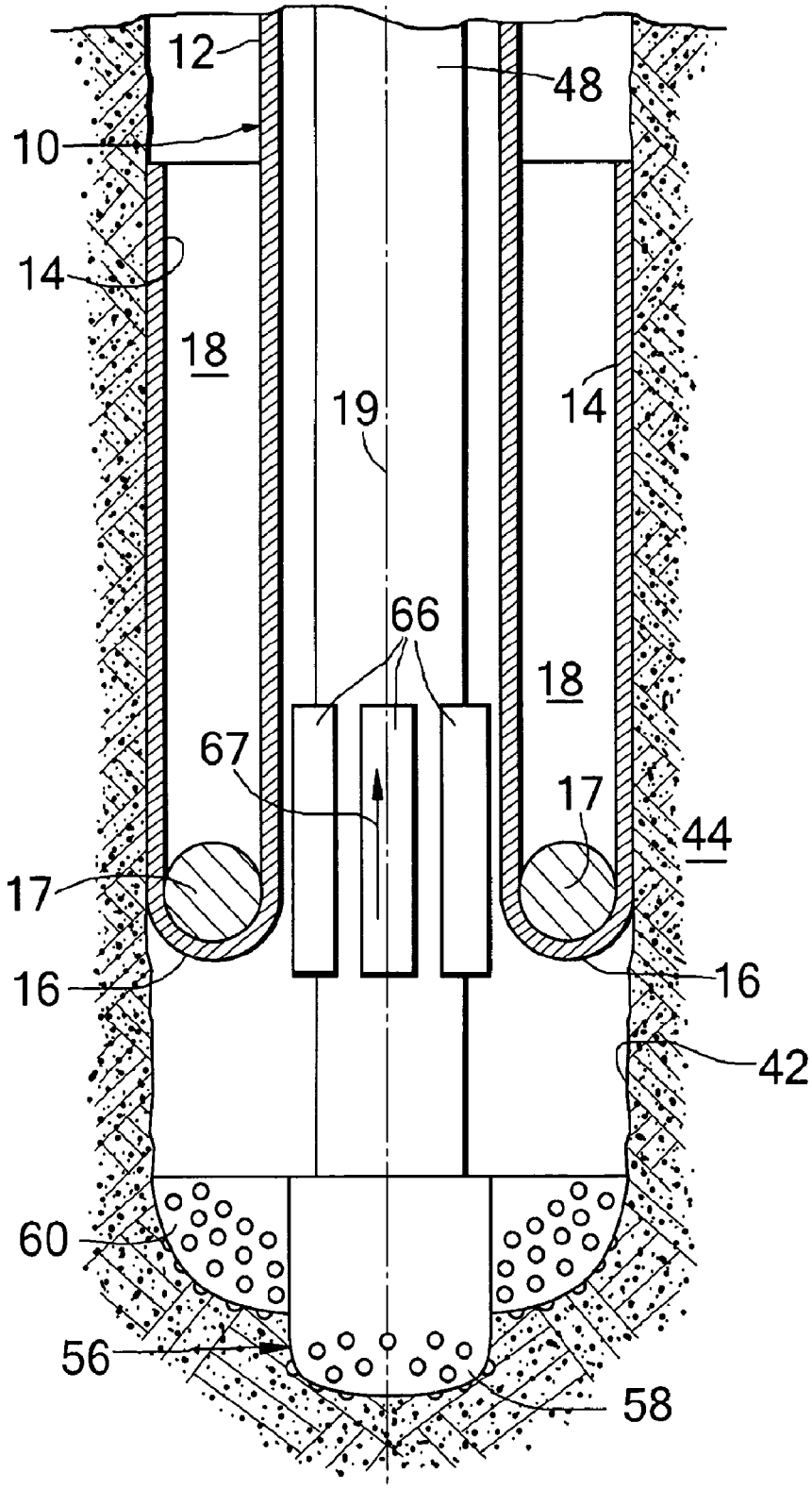
FIG. 10 schematically shows the fourth embodiment during a secondary stage of the expansion process.
Figure 11:
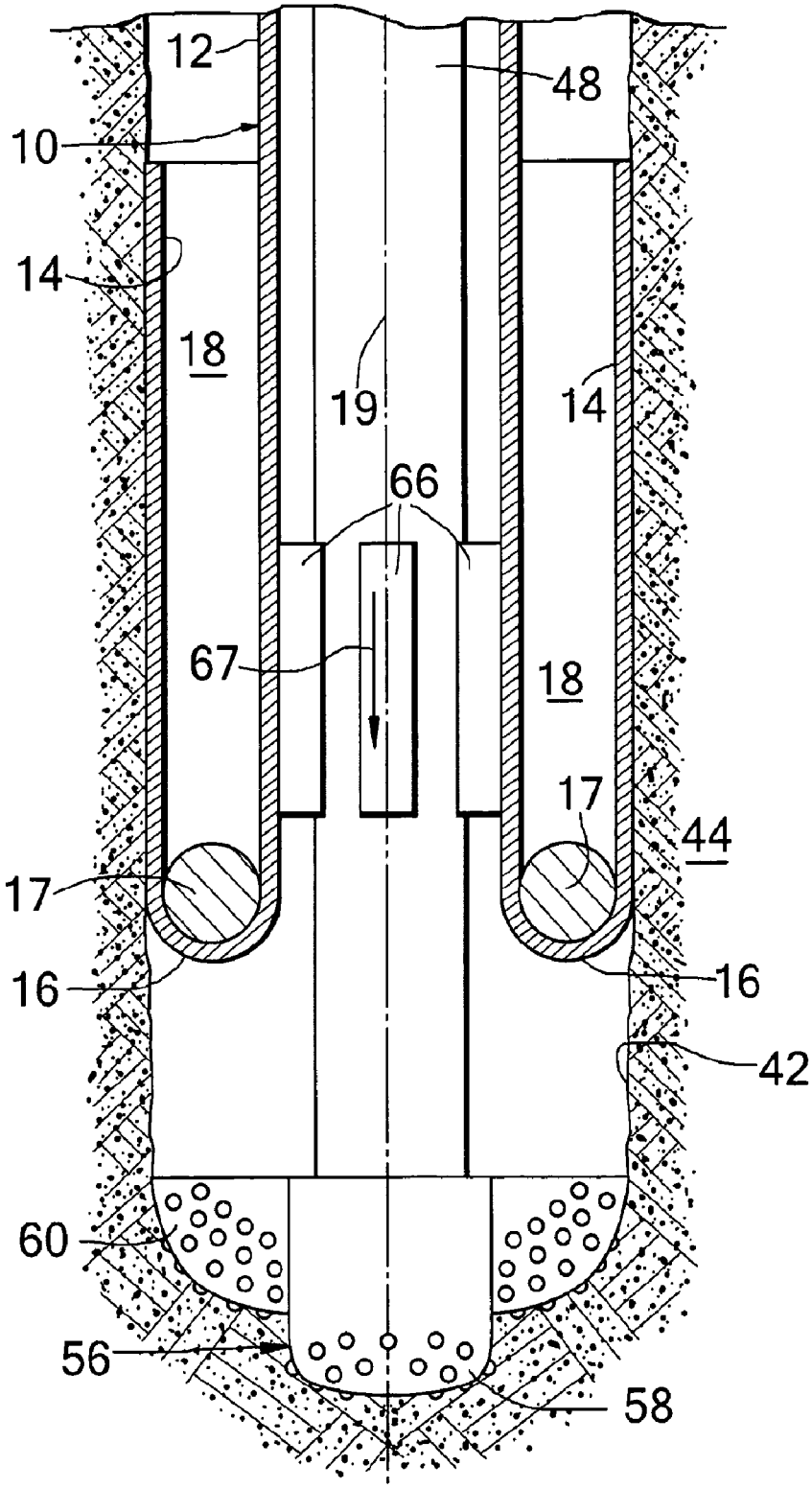
FIG. 11 schematically shows the fourth embodiment during a tertiary stage of the expansion process.

In FIGS. 9-11 is shown the fourth embodiment, which is substantially similar to the second embodiment except regarding the guide device. The fourth embodiment includes a guide device having a series of pads 66 circumferentially spaced around a lower portion of the drill string 48. The pads 66 are movable between a radially extended mode wherein the pads provide radial support to the unexpanded section 12 at the level of the U-shaped wall portion 16, and a radially retracted position wherein the pads 66 are free from the unexpanded section 12. Also, the pads 66 are axially movable between a lower position (FIG. 9) whereby the upper end of each pad 66 is located substantially at the level of the rollers 17, and an upper position (FIG. 11) whereby the lower end of each pad 66 is located substantially at the level of the rollers 17. Furthermore, the drill string 48 is provided with a control device (not shown) for moving the pads 66 between their respective retracted and extended positions, and between their respective upper and lower positions.

Normal operation of the fourth embodiment (FIGS. 9-11) is substantially similar to normal operation of the second embodiment, except that the control device induces each pad 66 to move in cycles whereby each cycle comprises, in subsequent order, the following steps:

a) the pad 66 is moved to its axially upper position while in radially retracted mode, b) the pad 66 is moved to its radially extended mode whereby the pad is biased against the unexpanded section 12 and thereby radially supports the unexpanded section 12 so as to prevent radially inward bending of the U-shaped wall portion 16, c) the pad 66 is allowed to move with the unexpanded section 12 in downward direction relative to the drill string 48, until reaching its axially lower position, d) the pad 66 is moved to its radially retracted mode. Reference sign 67 indicates the direction of movement of the pads 66.

Figure 12:
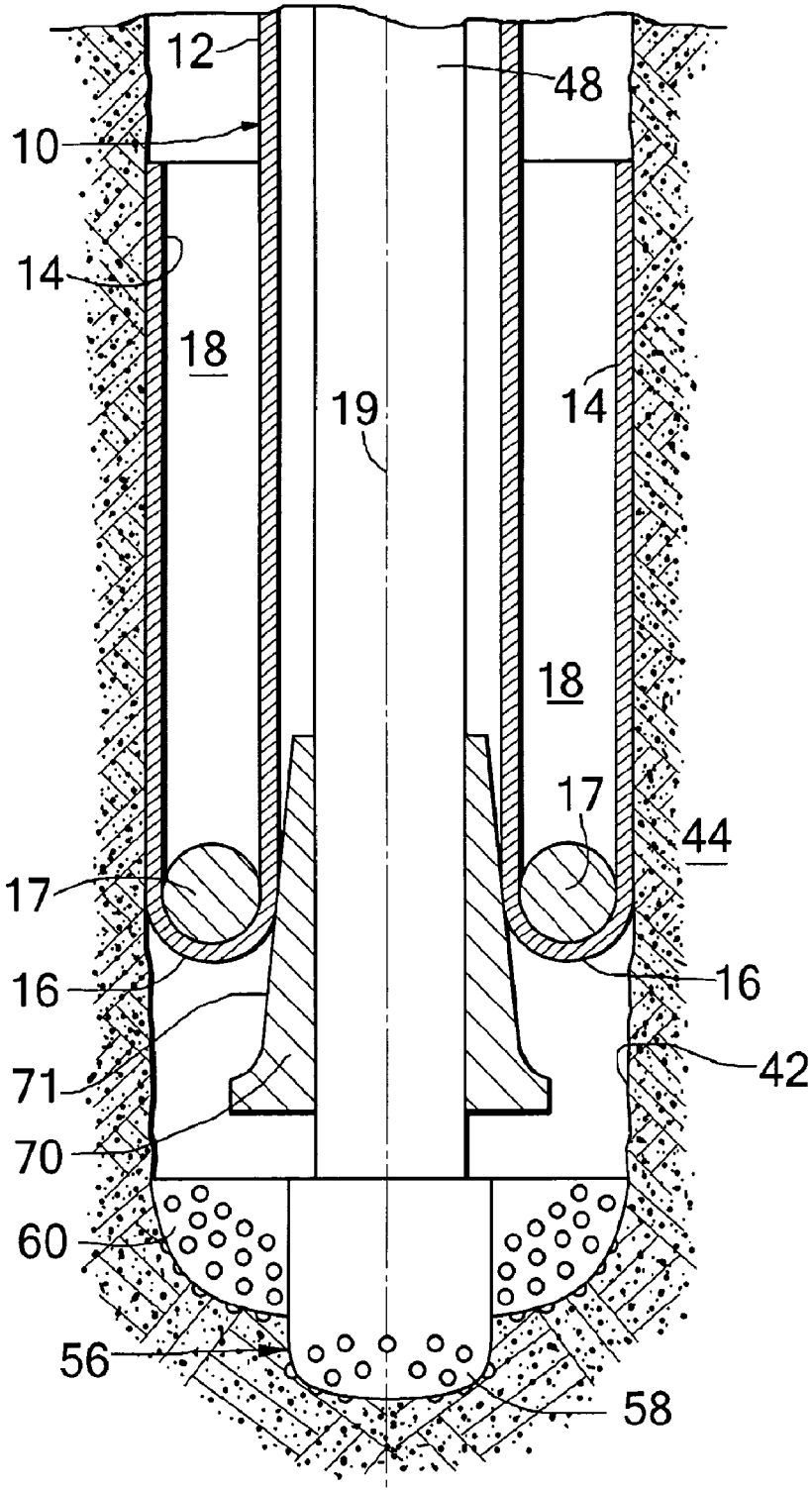
FIG. 12 schematically shows a fifth embodiment of a tubular element expanded with the method of the invention.

In FIG. 12 is shown the fifth embodiment, which is substantially similar to the second embodiment except with regard to the guide device. The fifth embodiment includes a guide device 70 having an outer surface 71 tapering in upward direction from a diameter slightly larger than the inner diameter of the unexpanded section 12 to a diameter slightly smaller than the inner diameter of the unexpanded section 12. The guide device 70 is connected to the drill string 48 such that the drill string 48 is allowed to rotate relative to the guide device 70 about central longitudinal axis 19.

Normal operation of the fifth embodiment (FIG. 12) is substantially similar to normal operation of the second embodiment, except for the following. The guide 15 device 70 radially supports the unexpanded section 12 so that inadvertent radially inward bending of the U-shaped wall portion 16 is prevented. The unexpanded section 12 slides in downward direction along the tapering surface 71 of the guide device 70 thereby generating axial 20 friction between the unexpanded section 12 and the guide device 70. The axial friction tends to move the guide device 70 downwardly relative to the U-shaped wall portion 16. However, in view of the upwardly tapering shape of guide device 70, any such downward movement 25 leads to a decrease of the friction forces. A tension applied to the drill string then moves the guide device 70 upward relative to the U-shaped wall portion 16. As a result the guide device 70 remains at an average axial position relative to the U-shaped wall portion 16, with 30 only minimal deviations from such average axial position. The average axial position itself is a function of the degree of tapering of the guide device, the material of the unexpanded section 12 and the guide device 70, the friction factor, and the magnitude of the axial force transmitted between the guide device 70 and the unexpanded section 12. The latter includes tension applied to the drill string.

Figure 13:
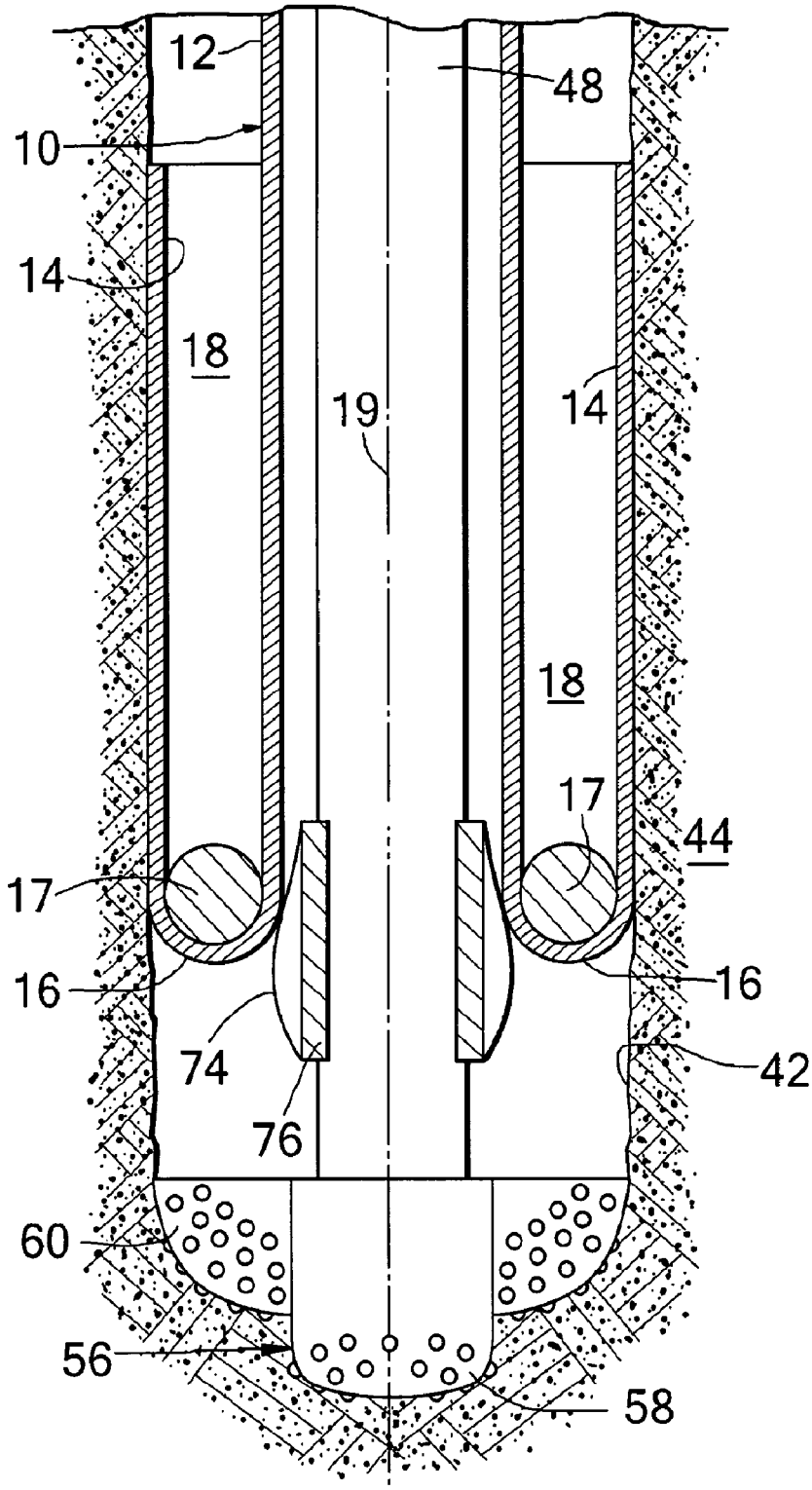
FIG. 13 schematically shows a sixth embodiment of a tubular element expanded with the method of the invention.

In FIG. 13 is shown the sixth embodiment, which is substantially similar to the second embodiment except with regard to the guide device. The guide device of the fifth embodiment comprises a bladder 74 connected to a ring 76 clamped to the drill string 48.

Normal operation of the sixth embodiment (FIG. 13) is substantially similar to normal operation of the second embodiment, except for the following. The bladder 74 is pressurised so as to exert a radially outward force to the U-shaped wall portion 16 thereby preventing radially inward bending of the wall of the tubular element 10. In one mode of operation the pressure in the bladder 74 is kept constant so that the unexpanded section 12 slides along the bladder 74. In another mode of operation the pressure in the bladder 74 is varied so that the unexpanded section 12 slides along the bladder 74 when the pressure is low, and that the bladder 74 moves with the unexpanded section 12 when the pressure is high.

With the method described above it is achieved that there is only a very short open-hole section in the wellbore 42 during drilling since the expanded tubular section 14 extends to near the lower end of the drill string 48 at any time. The method therefore finds many advantageous applications. For example, if the expanded tubular section is a casing, longer intervals can be drilled without the need to interrupt drilling to set new casing sections, thereby leading to fewer casing sections of stepwise decreasing diameter. Also, if the wellbore is drilled through a shale layer the substantial absence of an open-hole section eliminates problems due to shale heaving.

After drilling of the wellbore 42 has been finalised and the drill string 48 has been removed from the wellbore, the length of unexpanded tubular section 12 still present in the wellbore 42 can be cut-off from the expanded section 14 and subsequently retrieved to surface, or it can be left in the wellbore. In the latter case there are several options for completion of the wellbore, including for example:

i) A fluid, for example brine, is pumped into the annular space between the unexpanded and expanded sections 12, 14 so as to increase the collapse resistance of the expanded section 14. Optionally, an opening can be made in the wall of the tubular element 10, near its lower end, to allow the pumped fluid to be circulated therethrough;

ii) A heavy fluid is pumped into the annular space between the unexpanded and expanded sections 12, 14 to support the expanded tubular section 14 and increase its collapse resistance;

iii) Cement is pumped into the annular space between the unexpanded and expanded sections 12, 14 to create a solid body in the annular space after hardening of the cement. Suitably, the cement expands upon hardening;

iv) The unexpanded section 12 is radially expanded against the expanded section 14, for example by pumping, pushing or pulling an expander (not shown) through the unexpanded section 12.

Optionally a weighted fluid can be pumped into the annular space between the unexpanded and expanded sections, or the annular space can pressurized, during or after the expansion process, to reduce the collapse loading on the expanded section 14 and/or to reduce the burst loading on the unexpanded liner section 12.

Furthermore, electric wires or optical fibres can be arranged in the annular space between the unexpanded and expanded sections for downhole data communication or for downhole electric power transmission. Such wires or fibres can be attached to the outer surface of the tubular element 10 before expansion thereof. Also, the unexpanded and expanded sections 12, 14 can be used as electric conductors for transferring data and/or power downhole.

Since the length of unexpanded tubular section that is left in the wellbore does not need to be expanded, less stringent requirements regarding material properties etc. may apply to it. For example, said length may have a lower or higher yield strength, or a smaller or larger wall thickness than the expanded tubular section.

Instead of leaving a length of unexpanded tubular section in the wellbore after the expansion process, the entire tubular element can be expanded with the method of the invention so that no unexpanded tubular section remains in the wellbore. In such case, an elongate member, for example a pipe string, can be used to exert the necessary downward force to the unexpanded tubular section during the last phase of the expansion process.

Suitably a friction-reducing layer, such as a Teflon layer, is applied between the unexpanded and expanded tubular sections during the expansion process to reduce friction forces. For example, a friction reducing coating can be applied to the outer surface of the tubular element before expansion. Such layer of friction reducing material has the additional advantage of reducing the annular clearance between the unexpanded and expanded sections, thus resulting in a reduced buckling tendency of the unexpanded section.

With the method of the invention, the expanded tubular section can extend from surface into the wellbore, or it can extend from a downhole location deeper into the wellbore.

Instead of expanding the tubular element against the wellbore wall (as described above), the tubular element can be expanded against the inner surface of a tubular element previously installed in the wellbore.

Furthermore, instead of expanding the tubular element in downward direction in the wellbore, the tubular element can be expanded in upward direction whereby the U-shaped section is located at the upper end of the tubular element.

Although the examples described above refer to applications of the invention in a wellbore, it is to be understood that the method of the invention also can be applied at the earth surface. For example, the expanded tubular section can be expanded against the inner surface of a pipe, for example an existing flowline for the transportation of oil or gas located at the earth surface or at some depth below the surface. Thereby the flowline is provided with a new lining, thus obviating the need to replace the entire flowline in case of damage or corrosion of the flowline.

What is claimed is:

1. A method of radially expanding a tubular element, the method comprising inducing the wall of the tubular element to bend radially outward and in an axially reverse direction so as to form an expanded section of the tubular element extending around an unexpanded section of the tubular element, wherein said bending occurs in a bending zone of the wall, wherein an annular space is defined between the unexpanded and expanded sections, and wherein at least one guide member is located in the annular space, each guide member being arranged to guide the wall during said bending so that the wall bends at an increased bending radius relative to bending of the wall in case the guide member is absent from the annular space;

wherein a plurality of said guide members is located in the annular space, the guide members being regularly spaced along the circumference of the annular space.

2. The method of claim 1, wherein the guide member moves the expanded section radially outward relative to the unexpanded section during said bending by virtue of the guide member becoming compressed between the unexpanded and expanded sections.

3. The method of claim 1, further comprising, progressively increasing the length of said expanded section by axially moving the unexpanded section relative to the expanded section in the direction of the bending zone.

4. The method of claim 1 wherein each guide member includes a cylindrical body having a substantially circular cross-section and a longitudinal axis extending substantially perpendicularly to the radial direction of the tubular element so as to allow the guide member to roll along the wall in the bending zone thereof during axial movement of the unexpanded section relative to the expanded section.

5. The method of claim 4, wherein, for each guide member, the unexpanded section is at the outer surface thereof provided with a respective guide profile extending substantially parallel to a central longitudinal axis of the tubular element, the guide profile being adapted to allow the guide member to roll along the guide profile during axial movement of the unexpanded section relative to the expanded section.

6. The method of claim 5, wherein each guide profile comprises a groove formed in the wall of the unexpanded section.

7. The method of claim 1, wherein the tubular element extends into a wellbore formed in the earth formation.

8. The method of claim 7, wherein the bending zone of the wall is located at a lower end of the tubular element.

9. The method of claim 7, wherein the expanded section is kept stationary in the wellbore and the unexpanded section is moved in downward direction of the wellbore so as to progressively increase the length of the expanded section.

10. The method of claim 1, wherein a drill string extends through the unexpanded section and to the bottom of the wellbore, and wherein the drill string is operated to deepen the wellbore simultaneously with said bending of the wall.

11. The method of claim 10, wherein the unexpanded section and the drill string are simultaneously lowered through the wellbore during drilling with the drill string.

12. The method of claim 1, wherein the expanded section is compressed against the wellbore wall, or against another tubular element arranged in the wellbore, as a result of said bending of the wall.

13. The method of claim 1 wherein, for each guide member, the unexpanded section is at the outer surface thereof provided with a respective guide profile extending substantially parallel to a central longitudinal axis of the tubular element, the guide profile being adapted to allow the guide member to roll along the guide profile during axial movement of the unexpanded section relative to the expanded section.

14. The method of claim 13 wherein each guide profile comprises a groove formed in the wall of the unexpanded section.

* * * * *